US010220292B2

(12) United States Patent
Komlos

(10) Patent No.: US 10,220,292 B2
(45) **Date of Patent: *Mar. 5, 2019**

(54) ATHLETIC GLOVE

(71) Applicant: Under Armour, Inc., Baltimore, MD (US)

(72) Inventor: Jedd Komlos, Baltimore, MD (US)

(73) Assignee: UNDER ARMOUR, INC., Baltimore, MD (US)

( * ) Notice: Subject to any disclaimer, the term of this patent is extended or adjusted under 35 U.S.C. 154(b) by 16 days.

This patent is subject to a terminal disclaimer.

(21) Appl. No.: 15/643,657

(22) Filed: Jul. 7, 2017

(65) Prior Publication Data

US 2017/0304709 A1 Oct. 26, 2017

Related U.S. Application Data

(63) Continuation of application No. 14/518,669, filed on Oct. 20, 2014, now Pat. No. 9,707,467.

(60) Provisional application No. 61/892,542, filed on Oct. 18, 2013.

(51) Int. Cl.

| | |
|---|---|
| ***A63B 71/14*** | (2006.01) |
| ***A41D 19/015*** | (2006.01) |
| ***A41D 19/00*** | (2006.01) |
| *A63B 102/32* | (2015.01) |
| *A63B 102/18* | (2015.01) |

(52) U.S. Cl.

CPC ..... *A63B 71/148* (2013.01); *A41D 19/0044* (2013.01); *A41D 19/01558* (2013.01); *A63B 71/143* (2013.01); *A63B 71/146* (2013.01); *A63B 2102/18* (2015.10); *A63B 2102/32* (2015.10); *A63B 2243/007* (2013.01)

(58) Field of Classification Search

CPC ... A63B 71/148; A63B 71/143; A63B 71/146; A63B 2102/18; A63B 2102/32; A63B 2243/007; A41D 19/004; A41D 19/01558

See application file for complete search history.

(56) References Cited

U.S. PATENT DOCUMENTS

| | | | | |
|---|---|---|---|---|
| 4,004,295 | A * | 1/1977 | Byrnes, Sr. | A41D 19/01511 2/16 |
| 4,197,592 | A | 4/1980 | Klein | |
| 4,330,887 | A | 5/1982 | White | |
| 4,477,927 | A * | 10/1984 | Tsubota | A63B 71/143 2/19 |
| 4,497,072 | A * | 2/1985 | Watanabe | A41D 19/0065 2/161.1 |
| 4,628,544 | A | 12/1986 | Erickson | |
| 5,027,439 | A * | 7/1991 | Spector | A63B 71/143 2/161.1 |
| 5,088,123 | A | 2/1992 | MacDonald | |
| 5,117,509 | A * | 6/1992 | Bowers | A41D 19/01547 2/161.1 |

(Continued)

*Primary Examiner* — Andrew W Sutton

(74) *Attorney, Agent, or Firm* — Edell, Shapiro & Finnan, LLC

(57) ABSTRACT

An athletic glove includes a hand portion and a cuff portion. The hand portion includes a palm area and a plurality of digits. The palmar face of the glove further includes a grip enhancing surface disposed on one or more digits and/or the palm portion. The grip enhancing layer is positioned below the wrist and/or within the lower portion of the forearm to provide an extended contact surface to the wearer during gameplay.

13 Claims, 6 Drawing Sheets

(56) References Cited

U.S. PATENT DOCUMENTS

| | | | | |
|---|---|---|---|---|
| 5,418,980 | A | 5/1995 | Kelly | |
| 5,625,900 | A * | 5/1997 | Hayes | A41D 19/00 2/159 |
| 5,991,926 | A | 11/1999 | Lakusiewicz | |
| 6,161,221 | A * | 12/2000 | Hochmuth | A63B 71/148 2/161.1 |
| 6,226,795 | B1 * | 5/2001 | Winningham | A41D 13/084 2/20 |
| D605,377 | S | 12/2009 | House | |
| 7,725,950 | B2 | 6/2010 | Hinebaugh | |
| 2005/0160516 | A1 * | 7/2005 | Price | A41D 19/01547 2/161.6 |
| 2006/0218697 | A1 * | 10/2006 | Modha | A41D 19/0055 2/161.7 |
| 2008/0282446 | A1 * | 11/2008 | Komlos | A41D 19/015 2/167 |
| 2011/0179551 | A1 * | 7/2011 | VanErmen | A41D 19/01558 2/161.6 |
| 2012/0031938 | A1 | 2/2012 | Ballew | |
| 2013/0239291 | A1 * | 9/2013 | Harris | A41D 19/00 2/161.1 |
| 2013/0283864 | A1 * | 10/2013 | VanErmen | A41D 19/01505 66/174 |
| 2015/0040289 | A1 * | 2/2015 | Gaff | A63B 71/148 2/161.1 |
| 2015/0106997 | A1 * | 4/2015 | Komlos | A63B 71/143 2/161.1 |
| 2015/0251076 | A1 * | 9/2015 | Staton | A63B 71/143 2/161.1 |

* cited by examiner

ATHLETIC GLOVE

CROSS REFERENCE TO RELATED APPLICATIONS

The present application is a continuation of nonprovisional application Ser. No. 14/518,669, filed 20 Oct. 2014 and entitled "Athletic Glove," which claims priority to provisional application No. 61/892,542, filed 18 Oct. 2013 and entitled "Athletic Glove." The disclosure of each aforementioned application is incorporated herein by reference in its entirety.

FIELD OF THE INVENTION

The present invention is directed toward a glove used in athletic activities and, in particular, to a football receiving glove.

BACKGROUND OF THE INVENTION

In athletic matches such as baseball, golf, and American football, players will typically wear one or more gloves for protection and assistance on gripping items. Conventional athletic gloves extend to the wrist and include a mechanical fastener (e.g., a hook and loop fastener) to secure the glove to the hand of the wearer. This type of mechanical fastening suffers from several drawbacks. First, will loosen during a match, requiring a player to continuously adjust the fastener to properly secure the glove to the hand. Second, the fastener often interferes with the wrist flexure during play, causing a player to utilize the glove without securing the fastener. Third, such fasteners become caught on other players or equipment, interfering with game play.

In addition, the gripping area of such conventional gloves is limited to the area above the wrist and, in particular, the area above the mechanical fastener. Accordingly, these gloves limit the available gripping assistance available to the wearer, with the tactile pad termination just above the wrist.

Thus, it would be desirable to provide an athletic glove having improved durability that does not require the use of a mechanical fastener. In addition, it would be advantageous to provide a glove that provides increased gripping ability for the athlete.

BRIEF SUMMARY OF THE INVENTION

An athletic glove includes a hand portion and a cuff portion. The hand portion includes a palm area and a plurality of digits. The cuff portion includes a compression fastener operable to secure the glove to the hand. In an embodiment, the compression fastener is a continuous layer of elastic/resilient material encircling the wrist, biasing the cuff into contact with the wrist and/or forearm of the wearer. The cuff portion may extend beyond the wrist of the wearer, covering at least a portion of the lower forearm. The palmar face of the glove includes a grip enhancing surface disposed on one or more digits and/or the palm portion. In an embodiment, the grip enhancing layer is positioned below the wrist and/or within the lower portion of the forearm.

With this configuration, an athletic glove is provided that omits a mechanical fastener such as a strap with a hook and loop fastener, and extends the area available for the grip enhancing surface.

BRIEF DESCRIPTION OF THE SEVERAL VIEWS OF THE DRAWINGS

Like reference numerals have been used to identify like elements throughout this disclosure.

DETAILED DESCRIPTION OF THE INVENTION

Figure 1A:
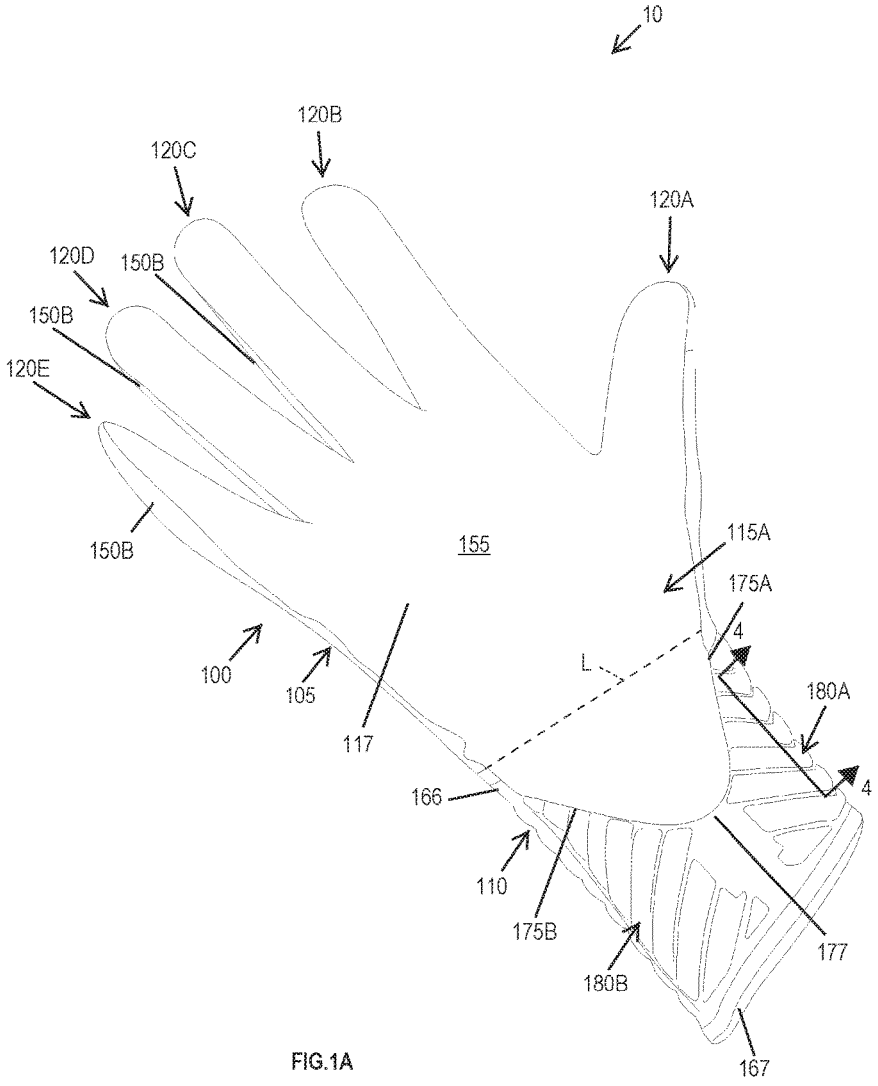
FIG. 1A is front perspective view of a glove in accordance with an embodiment of the invention, showing the palmar side of the glove.
Figure 1B:
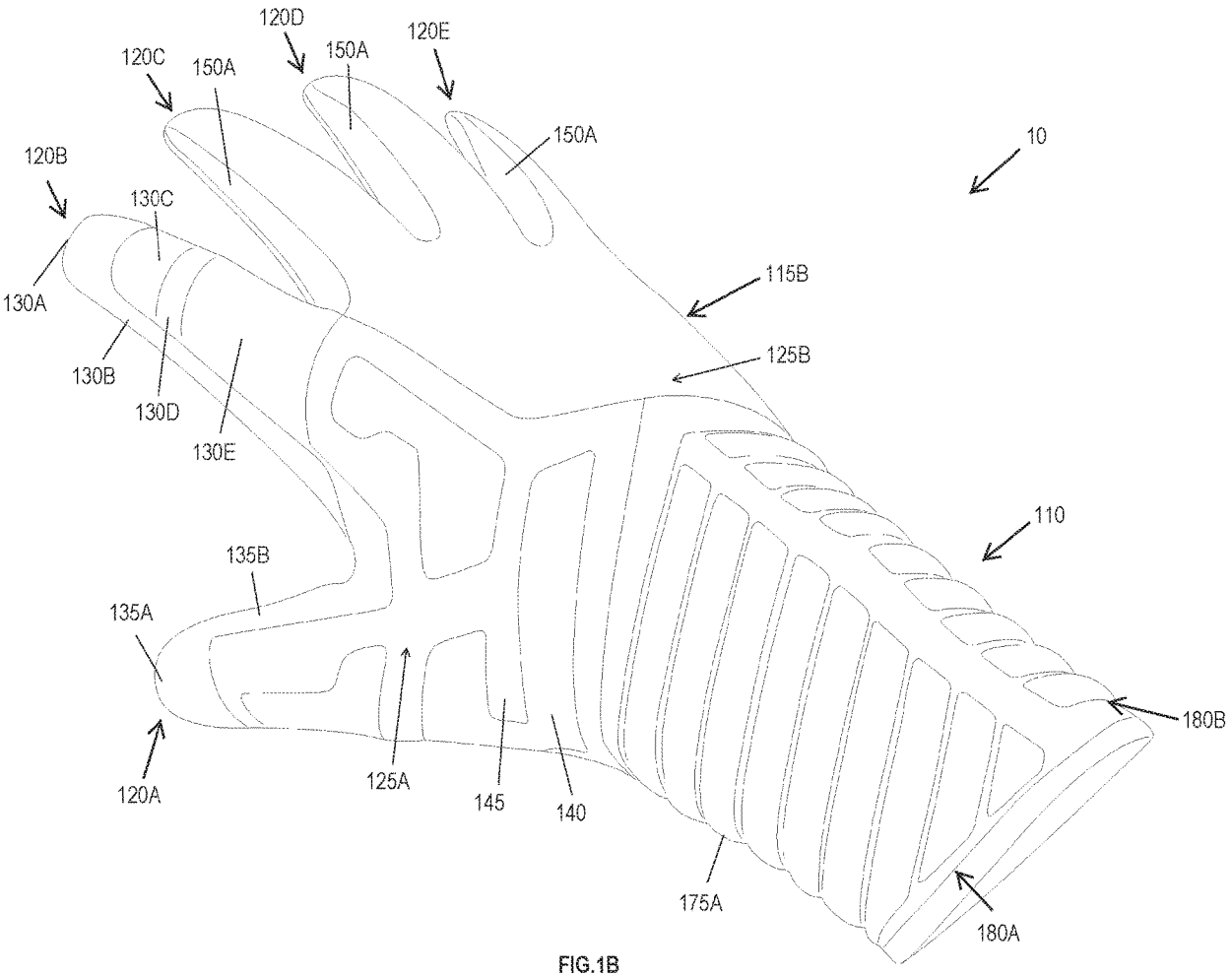
FIG. 1B is rear perspective view of a glove in accordance with an embodiment of the invention, showing the dorsal side of the glove.
Figure 1C:
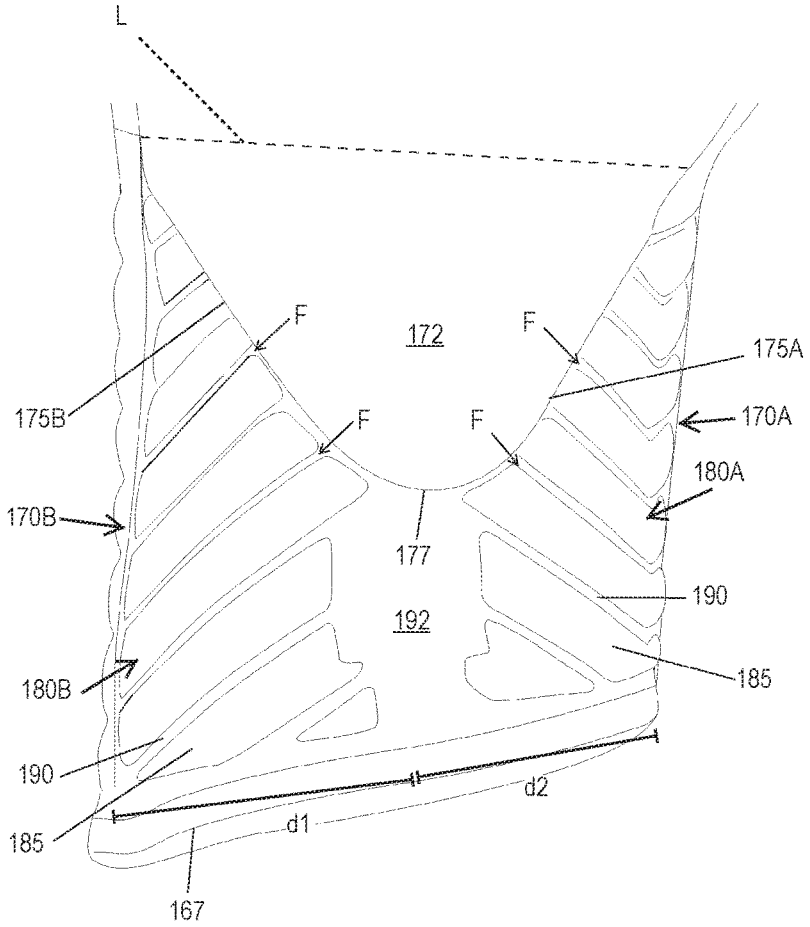
FIG. 1C is a close up of the cuff portion of the glove of FIG. 1A.

Referring now to FIGS. 1A, 1B, and 1C, an athletic glove 10 capable of receiving a human hand is shown. The athletic glove may be a receiving glove for American football. The athletic glove 10 includes a glove body 100 with a hand portion 105 and a cuff portion 110 (for clarity, the separation of cuff portion from hand portion approximated via line L in FIG. 1A). The glove body 100 defines a volar or anterior side 115A (also called a palmar side) and a dorsal or posterior side 115B. The hand portion 105 includes one or more digit sheaths and a palm section 117. In the illustrated embodiment, the glove 10 includes a first or thumb sheath 120A, a second or index finger sheath 120B, a third or middle finger sheath 120C, a fourth or ring finger sheath 120D, and a fifth or pinky finger sheath 120E. Each sheath 120A-120E possesses dimensions (e.g., is sized and shaped) to snugly receive and cover its associated digit, as well as to permit curvature of the fingers about an object such as an American football. One or more sheaths 120A-120E may be omitted if a partially fingerless glove is desired. For example, in a partially fingerless glove, an opening may permit a finger or the thumb to extend from glove 10 rather than encasing the finger or thumb in a sheath.

The glove body 100 may be formed of a single material or may be formed of a plurality of materials selectively coupled in predetermined positions to cover desired areas of the hand. Alternatively, the glove body 100 may include a unitary base layer of fabric material, with supplemental layers of material secured to the base layer at predetermined positions. In the embodiment shown in FIGS. 1A and 1B, the dorsal side 115B of the hand portion 105 includes a plurality of fabric materials connected in a predetermined pattern. Specifically, the dorsal side 115B is formed of a medial section 125A (the "thumb side" of the hand facing laterally inward when the arms are down and the palmar side of the hand faces the user) and a lateral section 125B (i.e., the "pinky side" of the hand, which faces laterally outward when the arms are down and the palmar side of the hand faces the user). The lateral section 125B spans a substantial portion of the back of the hand, extending laterally from the middle finger sheath 120C to the pinky finger sheath 120E (i.e., to the lateral side of the hand) and longitudinally from the tip of the sheaths 120C-120D down to the cuff portion 110. The lateral section 125B may be formed of a knitted, woven, or nonwoven fabric with stretch properties, e.g., a breathable fabric including elastane. With this configuration, the lateral section permits free motion of the fingers disposed within digit sheaths 120C-120E.

The medial section 125A spans the remaining area of the glove body dorsal side 115B, beginning proximate the lateral side of the index finger sheath 120B and extending medially to the thumb sheath 120A. The medial section 125A, housing the finger and thumb of the user, is configured to restrict movement of finger disposed within sheath 120B and/or thumb disposed within sheath 120A. For example, the medial section 125A may minimize torsion of the finger and thumb during use. Accordingly, the medial section 125A is formed of materials with less elasticity than the lateral section (i.e., the medial section includes non-stretch materials having less than 5% elongation).

The materials forming the medial section 125A, moreover, are structured to maintain the rotational position of both the finger and the thumb. As shown, the second sheath 120B (housing the index finger) includes a distal end or tip 130A and a medially-facing fourchette 130B (the fourchette facing the thumb) including friction-enhancing material 155 (i.e., the friction-enhancing material extends from the volar side to the dorsal side of the second sheath 120B, along not only the tip along the medial side of the sheath). A first structural band 130C is disposed below the grip-enhancing tip 130A. The band 130C, oriented transverse to the longitudinal axis of the second sheath 120B, may be formed of a non-stretch material such as a polyurethane (e.g., structured polyurethane) fabric. Below the first structural band 130C is a flexure panel 130D, positioned along the sheath 120B such that it generally aligns with the knuckle of the index finger. The flexure panel 130D permits flexure of the finger along the knuckle joint. Disposed below the flexure panel 130D is a second, transverse structural band 130E formed of non-stretch material (e.g., polyurethane fabric).

The first sheath 120A (housing the thumb) includes a tip 135A and a laterally-facing fourchette 135B (facing the index finger) formed of non-stretch material (e.g., polyurethane). The remainder of the medial section 125B, i.e., the remainder of the first sheath 120A and the area covering the opisthenar area of the hand, comprises a laminated mesh fabric. Specifically, a base layer of non- or low-stretch (<5% elongation) mesh 140 is reinforced with a thermoplastic film 145 at selected mesh locations (the film may be disposed on the exterior side of the mesh). In the illustrated embodiment, the thermoplastic film 145 borders the medial section 125B. Additionally, bridging structures of film 145 span the section in a generally transverse direction at predetermined locations, such as along the base of the thumb sheath 120A and across the opisthenar area of the hand. The thermoplastic film 145 includes, but is not limited to, polyurethane.

With this configuration of the medial section 125A (including the first and second sheaths including bands of non-stretch material), movement of the thumb and index finger within the first 120A and second 120B sheaths, respectively, is restricted. Specifically, the torsion or twisting of the finger and thumb is minimized. During sporting activities such as when a receiver catches an American football, the ball applies torque on the hand that twists the finger and thumb. This resulting torsional force interferes with the ability of the user to maintain control of the ball. Accordingly, limiting the torsion of the finger and the glove assists the user in maintaining control of the ball, reducing the chances of ball droppage. Specifically, the medial section 125A permits flexure of the fingers along the joints, but the areas of low stretch mesh and film resist the twisting motion created by the ball, stabilizing the thumb and finger when an exterior force is applied (e.g., the force generated by ball contact).

One or more sheaths 120A-120E may include a fourchette formed of elastic material to permit enhanced motion of the digit. In the illustrated embodiment, the third digit sheath 120C includes a medially-facing, elastic forchette 150A and a laterally facing, elastic fourchette 150B. Similarly, the fourth digit sheath 120D includes a medially-facing, elastic fourchette 150A spanning the medial (thumb-facing) side of the sheath and a laterally-facing, elastic fourchette 150B spanning the lateral (pinky-facing) side of the finger. Additionally, the second digit sheath 120B includes a laterally-facing, elastic fourchette 150B spanning the lateral side of the index finger, while the fifth digit sheath 120E includes a medially-facing, elastic fourchette 150B spanning the medial side of the pinky finger. The material forming the elastic fourchettes 150A, 150B may include, a breathable fabric formed of NYLON and spandex (e.g. LYCRA). The ends of the sheaths 120A-120E may be secured utilizing conventional configurations, such as a box finger or a pinch finger configuration.

The volar side 115A of the glove body further includes a grip- or friction-enhancing material 155 operable to enhance the gripping ability of the glove 10 to aid in gripping objects such as an American football. The friction-enhancing material 155 generally covers the palmar surface of the glove, extending longitudinally from the tip of each sheath 120A-120E of the bottom of the hand portion 105. In an embodiment, the friction-enhancing material 155 is disposed within the cuff portion 110 of the glove 10, e.g., extending continuously from the finger sheaths 120A-120E to a position below the user's wrist (discussed in greater detail below).

Figure 2:
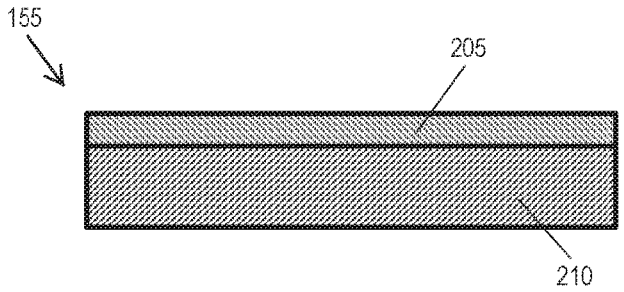
FIG. 2 illustrates a cross sectional view of the friction-enhanced surface of the glove of FIG. 1A.

Referring to FIG. 2, the grip-enhancing material 155 is a multilayer fabric including an interior, base layer 205 (also called a substrate layer) and an exterior, gripping layer 210 (also called a tacky layer) disposed on the base layer. In an embodiment, the base layer 205 may be flexible, non-stretch fabric (e.g., suede). By way example, the base layer may include textiles, fabric, leather, synthetic leather, etc.

The exterior or gripping layer 210 possesses a high adhesion property relative to the materials forming the glove. Additionally, the gripping layer generates a high coefficient of friction with material forming conventional game balls such as leather. For example, the gripping layer 210 may be formed of materials such as elastomers (e.g., polyurethanes), thermoset plastics (e.g., silicones), other plastics, polyvinyl chloride (PVC), rubber, synthetic rubber, leather, synthetic leather, or other polymeric materials. The gripping layer 210, moreover, may be a coating applied to the base layer 205. The gripping layer 210 may be a continuous layer, completely covering the base layer 205. Alternatively, the gripping layer 210 may be discontinuous, covering a portion (or selected portions) of the base layer 205. In an embodiment, the exterior layer is a thermoset plastic (e.g., silicone) that completely (or at least substantially) covers the volar side 115A of the hand portion 105, extending from the distal ends of the digit sheaths 120A-120E down to the heel of the palm (the bottom of the palm above the wrist).

In another embodiment, the friction-enhancing material 155, instead of being generally non-stretching, may be configured to provide four way stretch. For example, the grip enhancing mater may include a base layer 205 possessing four-way stretch. The friction-enhancing material may include additional layers such as a graphics adhesion layer, a graphics layer, and/or a protective layer. This enables the gloves to display a message either individually or in combination across the palms.

The friction-enhancing material 155 may be secured to the base layer via stitching, adhesive, etc. Additionally, the friction-enhancing material 155 may be perforated to improve breathability of the layer.

In accordance with an embodiment of the invention, the cuff portion 110 of the athletic glove 10 is elongated relative to conventional athletic gloves. Conventional gloves include a cuff or collar that terminates at the wrist of the user (i.e., at the carpal bones). Specifically, the grip enhancing layer terminates at the heel of the palm, to accommodate a mechanical fastener (e.g., a hook and loop fastener) generally aligned with the wrist. In contrast, the cuff portion 110 of the present invention begins proximate the upper edge of the wrist, extends over the carpal bones, and terminates within the forearm of the user, substantially below the wrist. For example, the cuff portion 110 may extend one inch to eight inches (e.g., 3 inches) below the wrist (the carpal bones) of the wearer (i.e., one to eight inches lower than conventional athletic gloves).

As seen in FIG. 1A, the cuff portion 110 extends longitudinally downward from the hand portion 105 to define a channel (e.g., a generally annular) that encloses the wrist and forearm portions of the wearer. The cuff portion 110 includes an upper or proximal end 166 and a lower or distal end 167 that defines the glove opening or collar. The proximal end 166 of the cuff portion 166 may possess a greater transverse dimension than the distal end 167 of the cuff portion such that the cuff portion 110 tapers inward in the distal direction (i.e., in the direction of the forearm). The terminal end 167 of the cuff portion 110 may be angled in the transverse direction such that the medial side 170A of the cuff portion possesses a length that is shorter than the lateral side 170B of the cuff portion. The terminal edge of the distal end 167 may be finished utilizing conventional methods such as an elastic zigzag stitch or a stretch (spandex) binding. With this configuration, the cuff portion 110 defines a continuous surface that encircles the wrist and arm of the wearer.

As noted above, in an embodiment, the athletic glove 10 includes an expanded grip-enhancing surface (expanded relative to conventional athletic gloves). During game play, it is often necessary for a user to secure an athletic ball (e.g., an American football) utilizing not only hands, but also the wrists and forearms. For example when a quarterback hands off to a running back, the running back initially grasps the ball by forming a pocket, holding forearms parallel to each other in front of the stomach, with each arm being bent at a 90° angle so that each forearm is parallel to the ground. Once the quarterback positions the ball within the pocket, the running back closes on the ball by bringing the forearms together. Additionally, once the running back or a receiver has possession of the ball, the running back grips the ball at its tip and tucks the other end into his elbow, with a portion of the ball resting against the forearm). Even a receiver attempting to catch a ball, a receiver, along with using the fingers, thumbs, and palms of the hand, will further use the wrist and or forearm to secure the ball. Thus, expanding the grip-enhancing material 155 of the glove to assist an athlete during gameplay.

Accordingly, in an embodiment, the grip-enhancing material 155 extends from the hand portion 105 into cuff portion 110 to define an expanded grip-enhancing surface 172. That is, the grip enhancing material 155 is not limited to the finger and palm area as in conventional athletic gloves, but extends into at least the wrist area and, in some embodiments, into the forearm area. By way of specific example, the friction-enhancing material 155 is a continuous surface, extending from the distal ends of the digit sheaths 120A-120E (the tips of the fingers) to a point that is substantially beyond the wrist, e.g., terminating within the forearm area. This is in contrast to conventional athletic gloves, which limit any grip-enhancing surface to the area the heel of the hand, just above the wrist. Conventional termination of the grip-enhancing surface is indicated by dashed line L in FIGS. 1A and 1C.

The overall dimensions (shape and/or size) of the grip-enhancing material 155 may be any suitable for its described purpose. Thus, in the illustrated embodiment, the friction-enhancing material 155 is a continuous layer, being substantially coextensive with the palmar (anterior) side of the fingers, the palm, the wrist, and the forearm. The friction-enhancing material 155 may span the entire transverse dimension of the volar side of the fingers, palm, wrist, and forearm. Alternatively, as seen best in FIG. 1C, the friction-enhancing material 155 may taper inward (narrow) in the distal direction (the direction of the forearm) to define a medial edge 175A, and a lateral edge 175B that meet along a generally curved nadir 177 oriented slightly offset from the center of the cuff portion (i.e., the lateral side 180B transverse dimension, indicated by d1 is greater than the medial side transverse dimension, indicated by d2). This tapered configuration permits additional compression material to surround and apply a biasing force to the wrist and forearm of the user.

The cuff portion 110, furthermore, functions as a compressive fastener operable to secure the glove to the hand of the user by applying a biasing force to the wrist and forearm. In an embodiment, the entire cuff portion 110 is formed of highly elastic, compression fabric (also called stretch fabric) that biases the cuff portion into contact with the skin of the wrist and/or arm. By way of example, the compression fabric includes an elastic fiber such as elastane. Elastic fibers are resilient, thus can be stretched from its normal position, but will return back to its normal position upon release of the exterior force. By way of further example, the cuff portion 110 is formed of multiple layers (e.g., two or three layers) of polyurethane cast LYCRA material.

Figure 3A:
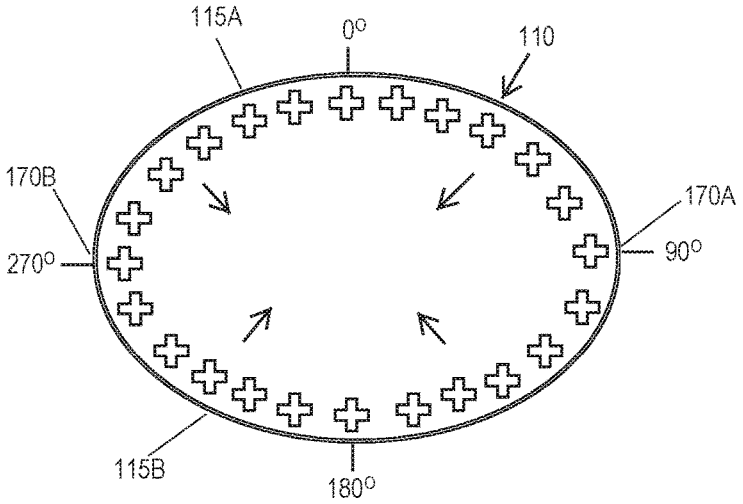
FIG. 3A illustrates schematic showing the radial biasing force applied along the cuff portion in accordance with an embodiment of the invention.
Figure 3B:
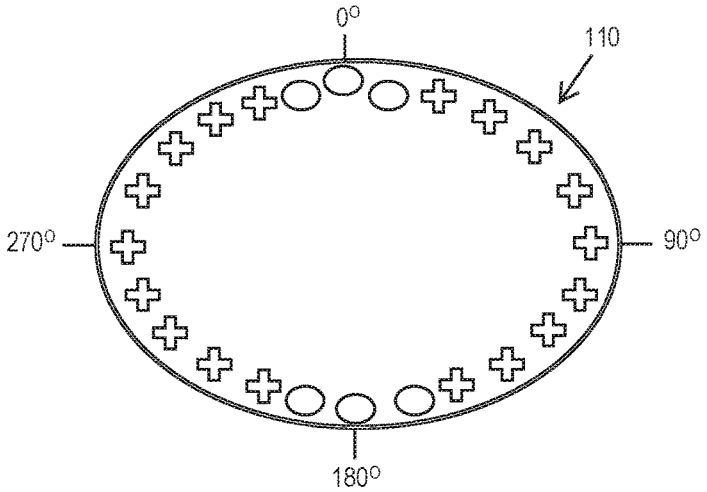
FIG. 3B illustrates a schematic showing the radial biasing force applied along the cuff portion in accordance with an embodiment of the invention.

The compression fabric may apply the biasing force generally evenly throughout the entire area of the cuff portion 110 (e.g., throughout 360°). Referring to FIG. 3A, it can be seen the biasing force (indicated by "+" symbol) is applied generally equally throughout the rotational angle of the cuff portion 110. In other embodiments, the cuff portion 110 may apply the biasing force selectively, e.g., along limited arcs of the wrist and/or forearm. Referring to FIG. 3B, it can be seen that the cuff portion 110 applies a biasing force along two arcs, one from about 20° to about 160°, and another from about 200° to about 340°. The other areas are non-compression areas (indicated by "o"). This selective compression may be provided by the weave/knit of the fabric, selectively weaving/knitting compression/non-compression areas into the fabric. Alternatively, the selective compression of the cuff portion 110 may also be provided forming the cuff portion 110 of different fabrics, e.g., forming sections or strips of the cuff portion with compression fabric and forming section or strips of the cuff portion with a fabric possessing less compression force than the compression fabric (e.g., little to no compression force).

The cuff portion 110 may further include a plurality of ribs or protrusions operable to increase the compressive force of the cuff portion 110, provide cushioning/padding, and/or define fluid-directing channels. Specifically, each of the dorsal 115B and volar 115A sides of the cuff portion 110 includes a first or medial plurality 180A of spaced ribs or protrusions 185 and a second or lateral plurality 180B of spaced ribs 185 or protrusions. The gap between adjacent ribs 185 defines a channel operable to direct fluid flowing from the hand portion 110 of the glove (e.g., from the friction-enhancing material 155). As shown, each rib 185 of the plurality 180A, 180B is angled relative to a generally vertical notch 192 extending longitudinally from the nadir 177 to distal cuff portion end 167. Specifically, each rib of the plurality 180A, 180B is inclined from a side 175A, 175B toward the notch 192.

Figure 4:
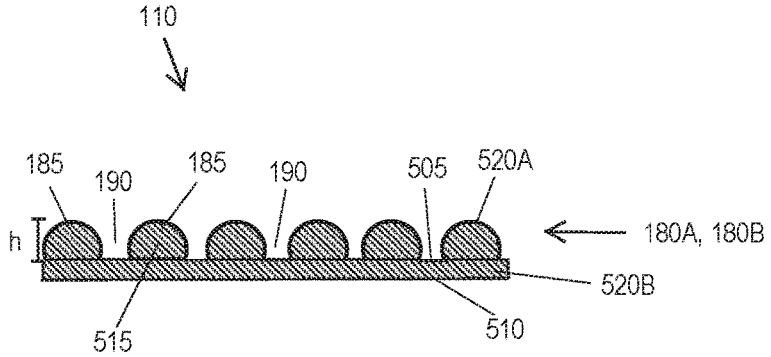
FIG. 4 illustrates a cross sectional view taken along line 4-4 of FIG. 1A, showing the rib and channel structure of the cuff portion.

Specifically, referring to FIG. 4, the cuff portion 110 (and, accordingly, the compression fabric) defines an exterior side 505 and an interior (user or skin facing) side 510. The interior side 510 may be structured such that its surface possesses a coefficient of friction effective to minimize or prevent movement along the skin. The ribs 185 are generally tubular or polygonal members disposed on the exterior side 505 of the cuff portion 110. The ribs 185, which possess height h, are oriented in spaced relation to each other, being oriented generally parallel to each other to define the generally open channels 190 along cuff exterior side 505. The ribs 185 are formed of an impact-absorbing material such as foam. As shown, the ribs 185 are formed of foam 515 laminated between a first layer 520A of compression material and a second layer 520B of compression material. The foam 515 may possess a lower modulus of elasticity than the compression material 520A, 520B surrounding foam. By way of specific example, the ribs 185 are formed of closed-cell neoprene foam. In an embodiment, the ribs 185 may be perforated to increase breathability. With this configuration, the ribs 185, while permitting expansion of the compression material, limit the expansion beyond a predetermined distance. Additionally, the ribs 185 provide cushioning, protecting the wrists during game play.

As noted above, the channels 190 may be in communication with the surface of the friction-enhancing material 155. Specifically, one or more channels 190 defined by the medial set of ribs 180A abut the medial edge 175A of the friction-enhancing material 155, while one or more channels 190 defined by the lateral set 180B of ribs 185 abut the lateral edge 170B of the grip-enhancing surface. With this configuration, the channels 190 direct the flow of fluid off of the surface of the friction-enhancing material 155 (indicated by arrows F). Accordingly, water that lands on the surface of the friction-enhancing material 155 will flow downward, off of the surface and into the channels 190, being directed off of the glove 10 and away from the anterior surface of the forearm.

In operation, the cuff portion 110, which defines a generally annular channel, is initially disposed a first or normal position (also called an unstretched position). In this position, the diameter of the channel is such that the cuff portion does not apply a radially inward biasing force. As the wearer inserts a hand through the cuff portion 110 (via the opening on the cuff portion distal end 167), the diameter of the channel increases to accommodate the hand. Stated another way, due to the taper and/and or reduced diameter of the cuff portion 110 relative to the hand of the wearer, the user must apply a radially outward force to expand the channel from the normal position to a second or application position. In the application position, the outward force expands the channel diameter to permit passage of the hand therethrough.

Once the hand passes through the cuff portion 110 and enters the hand portion 105, the hand portion 105 of the glove generally aligns with the hand of the wearer. Specifically, each sheath 120A-120E receives a corresponding digit on the hand, and the remainder of the hand portion 105 generally aligns with the heel of the palm and the back of the hand (the areas of the hand below the fingers of the wearer). The cuff portion 110 generally aligns with the wrist and forearm of the wearer, extending over the carpal bones and into the arm (e.g., forearm), covering the distal (hand facing) portion of the radius and ulnar bones of the wearer's arm. In an embodiment, the cuff portion 110 extends less than half way between the carpal bones and the elbow. In another embodiment, the cuff portion 110 extends less than one fifth of the way between the carpal bones and the elbow.

Once aligned with the wrist, the cuff portion 110 is disposed in a third or locking position. That is, once the hand passes into the hand portion 105, the cuff portion 110 is drawn radially inward, toward the skin of the wearer. In this position, the diameter of the channel is still enlarged, i.e., the cuff portion cannot return to its normal, unstretched position. Accordingly, the cuff portion 110, which encircles the wrist and forearm, applies a compressive force thereto. This compressive force is sufficient to secure the glove to the hand of the wearer without the need to use mechanical fasteners such hook and loop fasteners.

With the above-described configuration, an athletic glove (e.g., a receiver's glove) is provided that does not require the use of mechanical fasteners (due to the compressive force applied by the cuff portion). Additionally, the surface area of enhanced friction is greater compared to conventional gloves, extending through and below the wrist of the wearer.

While the invention has been described in detail and with reference to specific embodiments thereof, it will be apparent to one skilled in the art that various changes and modifications can be made therein without departing from the spirit and scope thereof. For example, while only a right handed glove has been illustrated, it should be understood that the left handed version includes the same features, being a mirror image of the right handed glove. A left handed glove and a right handed glove may define a pair worn by a user.

The glove may include other features such as padding, hard plastic shells, pockets or other storage compartments. The athletic glove 10 may also include an expansion panel running longitudinally along the side 175A, 175B of the glove, extending from the hand 105 to the cuff 110 portions. The expansion panel assists a user in putting the glove on and taking the glove off. The cuff portion 110 of the glove 10 may further include one or more apertures that function as finger pulls, assisting a user in pulling on the glove. For example, a first aperture is disposed on the lateral side 180B of the cuff portion 110 and a second aperture is disposed on the medial side of the cuff portion, both proximate the distal cuff end 167. The apertures may be located on one or both of the palmar side 115A or dorsal side 115B of the glove. In operation, a user inserts one or more fingers through one or both apertures, drawing the glove 10 onto the hand.

In another embodiment, the compression force may be provided by a cord incorporated into the cuff portion. Specifically, the cuff portion 110 of the glove 10 may include a longitudinal opening with tongue (e.g., a neoprene tongue) or gusset disposed on the interior side of the cuff portion such that it spans the opening. A plurality of eyelets/grommets is disposed on each side of the opening. The eyelets are aligned vertically along its corresponding side, but are offset transversely (across the opening). An elastic cord is threaded through eyelets/grommets such that the cord repeatedly crosses the opening. The elastic cord may include a core of elastic strands surrounded by a generally non-elastic and configured such that a longitudinal pull causes the sheath to squeeze the core, transmitting the core's elastic compression to the longitudinal extension of the sheath (and thus the cord). With this configuration, the elastic cord causes the cuff portion to generate a predetermined biasing force sufficient to secure the glove to the hand. In addition, a user may select the strength of the biasing force by selecting a particular elastic cord. That is, the glove may be part of a system including the glove, a cord having a first biasing force and a cord having a second biasing force that is greater than the first. Accordingly, the user selects the desired biasing force by selecting the appropriate cord.

The material forming the cuff portion 110 may also extend into the hand portion 105. For example, the compression material may form a portion of the thumb sheath 120A. Specifically, the compression material forms a proximal portion of the sheath 120A, generally spanning the lower thumb joint (e.g., extending along the medial side of the metacarpal bone). With this configuration, the cuff portion 110 is positioned higher along the thenar area of the hand compared to the embodiment of FIG. 1A.

The ribs 185 may possess any dimensions (size and shape) suitable for their described purpose. By way of example, the ribs 185, moreover, are generally triangular, forming generally triangular channels. The number of ribs 185 in the plurality 180A, 180B may be any suitable for its described purpose.

In an embodiment, the biasing force may be adjusted via an adjustment member. Specifically, the athletic glove may include a cuff portion 110 including a longitudinal slit or opening formed therein. A gusset spans the opening. Both the cuff portion and the gusset are formed of compression material. The gusset, however, may be formed of compression material having a lower degree of compression than that of the cuff portion material. Alternatively, the gusset may be formed of material having a similar or higher degree of compression. An adjustment system is provided to selectively adjust the opening, thereby the level of compression applied to the wrist. For example, the adjustment member may be a strap that extends across the opening. The strap includes one part of hook and loop material that mates with the other part of the hook and loop material, which is disposed on the other side of the opening opposite the strap. With this configuration, a user may wrap the strap across the wrist, closing the opening, and securing the strap in position. This, in turn, permits a user to adjust the degree of compression. In addition, the opening assists a user in placing the glove on and removing the glove from the hand. Finally, this configuration provides a compression secured glove, while still providing the feel of a conventional, mechanical fastener glove.

Other adjustment members may be utilized to adjust the level of compression on the wrist. For example, various mechanical closures such as zippers, BOA closures, etc., may be utilized. By way of specific example, a closure system, e.g., a BOA closure system is secured to the glove. The closure system includes cables extending along the cuff such that the wrist is surrounded by the cables. A central hub is configured to draw in the cables when activated, causing the cables to grasp the wrist, securing the athletic glove to the user.

With the above described compression fastener configurations, the need for a mechanical fastener to secure the glove to the hand is eliminated. Even when present, the mechanical fastener merely supplements the compression force applied by the cuff portion 110.

Mechanical fasteners such as hook and loop fasteners are problematic in that they loosen during use, requiring the player to tighten them regularly. In addition, some players (e.g., baseball players or football players) find that the mechanical fasteners interrupt the ability to properly flex their wrists. As a result, these players do not engage/clamp the fastener to avoid interference with wrist flexure. Omission of the mechanical fastener, moreover, permits the extension of the grip enhancing surface not only into the wrist area, but also beyond the wrist area into the forearm area. Thus, the athletic glove of the present invention does not require the use of strap fasteners, hook and loop fasteners, or tie-up fasteners.

Thus, it is intended that the present invention covers the modifications and variations of this invention provided they come within the scope of the appended claims and their equivalents. It is to be understood that terms such as "top", "bottom", "front", "rear", "side", "height", "length", "width", "upper", "lower", "interior", "exterior", and the like as may be used herein, merely describe points of reference and do not limit the present invention to any particular orientation or configuration.

What is claimed is:

1. An athletic receiving glove comprising:

a glove body including:

a hand portion configured to cover a hand of a wearer, the hand portion of the glove comprising a plurality of digit sheaths, each digit sheath of the plurality of digit sheaths being configured to receive a finger or a thumb of a hand, and a cuff portion disposed below the hand portion, wherein the cuff portion defines a 360° rotational angle, and the cuff portion applies a biasing force that changes along arcs of the rotational angle; and a grip-enhancing layer disposed on the glove body, the grip-enhancing layer extends continuously from the plurality of digit sheaths to the cuff portion, wherein the grip-enhancing layer comprises a multilayer structure including a base layer, a graphics layer, and a tacky layer.

2. The athletic glove according to claim 1, wherein:

the glove body defines a dorsal side and a volar side; and the grip-enhancing layer is positioned on only the volar side of the glove.

3. The athletic glove according to claim 1, wherein the cuff portion is configured to extend over the wrist and arm of the wearer and to position the grip-enhancing surface over a volar portion of a forearm.

4. The athletic glove according to claim 1, wherein:

the plurality of digit sheaths include a first sheath configured to receive a thumb and a second sheath configured to receive a finger; and each of the first sheath and second sheath includes a non-stretch material.

5. The athletic glove according to claim 1, wherein the grip-enhancing layer extends from a volar side of the second sheath to a dorsal side of the second sheath.

6. The athletic glove according to claim 1, wherein:

the cuff portion is formed from a fabric material that includes areas that vary an amount of compression force applied by the cuff portion along selected arcs of the rotational angle so as to vary the biasing force applied by the cuff portion along the rotational angle.

7. An athletic receiving glove for wearing on a hand, the athletic glove comprising:

a glove body defining a volar side and a dorsal side, the glove body further including: a hand portion including a plurality of the digit sheaths, the plurality including a plurality of finger sheaths, each finger sheath of the plurality being configured to receive a finger of the hand, and a thumb sheath configured to receive a thumb of the hand, wherein the volar side of the glove body includes a palm section of the glove body, and wherein the dorsal side of the glove body includes a medial section operable to restrict motion and a lateral section operable to permit free movement;

a cuff portion disposed below the hand portion, the cuff portion being configured to cover wrist and arm portions, wherein the cuff portion defines a 360° rotational angle, and the cuff portion applies a biasing force that changes along arcs of the rotational angle; and a grip-enhancing layer coupled to the volar side of the glove body, the grip-enhancing layer extending continuously from the plurality of finger sheaths to the cuff portion, wherein the grip-enhancing layer comprises a multilayer structure including an interior base layer and an exterior tacky layer.

8. The athletic receiving glove according to claim 7, wherein the tacky layer is continuous layer completely covering the base layer.

9. The athletic receiving glove according to claim 7, wherein:

the cuff portion extends from the palm section on the volar side and the medial and lateral sections on the dorsal side, is configured to cross carpal bones of the wrist portion, and is configured to terminate within the arm portion; and the grip-enhancing layer is disposed within the cuff portion such that it is configured to be positioned within the arm portion.

10. The athletic receiving glove according to claim 7, wherein the grip-enhancing layer further extends from a volar side to a dorsal side of a finger sheath.

11. The athletic receiving glove according to claim 7, wherein the grip-enhancing layer tapers within the cuff portion such that the grip enhancing layer narrows in a transverse dimension.

12. The athletic receiving glove according to claim 7, wherein the cuff portion includes a mechanical fastener operable to secure the glove to the wearer.

13. The athletic glove according to claim 7, wherein:

the cuff portion defines a 360° rotational angle; and the cuff portion is formed from a fabric material that includes areas that vary an amount of compression force applied by the cuff portion along selected arcs of the rotational angle so as to vary the biasing force applied by the cuff portion along the rotational angle.

* * * * *